US005469622A

United States Patent [19]

Gradoni

[11] Patent Number: 5,469,622

[45] Date of Patent: Nov. 28, 1995

[54] PIZZA CUTTING SCISSORS

[76] Inventor: John T. Gradoni, 39 Wertman La., Loudonville, N.Y. 12211

[21] Appl. No.: 332,853

[22] Filed: Nov. 1, 1994

[51] Int. Cl.[6] ..... B26B 11/00

[52] U.S. Cl. ..... 30/146; 30/131; 30/114

[58] Field of Search ..... 30/131, 142, 145, 30/146, 288, 292, 254, 244, 114, 124; D8/57

[56] References Cited

U.S. PATENT DOCUMENTS

| | | | |
|---|---|---|---|
| 245,186 | 8/1881 | Lowe | 30/146 |
| 370,005 | 9/1887 | Buddington | 30/146 |
| 592,945 | 11/1897 | Youngblood | 30/146 |
| 3,174,223 | 3/1965 | Gerson | 30/142 |
| 3,711,945 | 1/1973 | Cronheim | 30/142 |
| 4,423,551 | 1/1984 | Chmela et al. | 30/142 |

*Primary Examiner*—Hwei Siu Payer

[57] ABSTRACT

A pizza cutting scissor comprising: a first scissor blade having a front segment and a rear segment, the front segment formed in a planar rectangular configuration with a sharp inboard edge and a dull outboard edge, the blade including a screw aperture, the rear segment being formed in a planar circular configuration with a large aperture extending therethrough, the rear segment being coupled upon the rearward extent of the front segment, a second scissor blade having a front segment and a rear segment, the front segment formed in a planar rectangular configuration with a sharp inboard edge and a dull outboard edge, the front segment being slanted forming an angle of between about one hundred and one hundred and fifty degrees, the blade having a screw aperture extending therethrough, the rear segment being formed in a planar circular configuration with a large aperture extending therethrough, the rear segment being coupled upon the rearward extent of the front segment, a planar circular cutter with a sharp outer edge being coupled between the blades with a nut and bolt.

4 Claims, 4 Drawing Sheets

PIZZA CUTTING SCISSORS

BACKGROUND OF THE INVENTION

1. Field of the Invention

The present invention relates to pizza cutting scissors and more particularly pertains to cutting pizza in an efficient and precise manner with the specially angled blades and circular cutter of the apparatus.

2. Description of the Prior Art

The use of pizza cutters is known in the prior art. More specifically, pizza cutters heretofore devised and utilized for the purpose of cutting pizza into a plurality of slices are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,738,028 to Belokin a pizza cutter.

U.S. Pat. No. 4,574,479 to Gramann discloses a pizza cutter.

U.S. Pat. No. 4,250,618 to Custer discloses a pizza cutter.

U.S. Pat. No. 5,228,200 to Meehan discloses a microwave tool.

Lastly, U.S. Pat. No. 5,179,783 to Melter discloses an all purpose scissors.

In this respect, the pizza cutting scissors according to the present invention substantially depart from the conventional concepts and designs of the prior art, and in doing so provides an apparatus primarily developed for the purpose of cutting pizza in an efficient and precise manner with the specially angled blades and circular cutter of the apparatus.

Therefore, it can be appreciated that there exists a continuing need for new and improved pizza cutting scissors which can be used for cutting pizza in an efficient and precise manner with the specially angled blades and circular cutter of the apparatus. In this regard, the present invention substantially fulfills this need.

SUMMARY OF THE INVENTION

In view of the foregoing disadvantages inherent in the known types of pizza cutters now present in the prior art, the present invention provides improved pizza cutting scissors. As such, the general purpose of the present invention, which will be described subsequently in greater detail, is to provide new and improved pizza cutting scissors and method which has all the advantages of the prior art and none of the disadvantages.

To attain this, the present invention essentially comprises a new and improved pizza cutting scissor comprising, in combination: a first scissor blade having a front segment and a rear segment, the front segment being fabricated of steel and formed in a long planar generally rectangular configuration, the front segment having a sharp inboard edge and a dull outboard edge, the rearward end of the front segment having a larger width than the frontward end with a gradually decreasing diameter therebetween, the furthest extent of the frontward end being formed into a point, the rearward end having a screw aperture extending therethrough, the rear segment being fabricated of plastic and formed in a generally planar oval configuration with a large oval aperture extending therethrough, the rear segment having a hole at its furthest frontward extent to permit coupling upon the furthest rearward extent of the front segment, the rear segment adapted to be held with the user's fingers extending therethrough in the operative orientation; a second scissor blade having a front segment and a rear segment, the front segment being fabricated of steel and formed in a long planar generally rectangular configuration, the front segment having a sharp inboard edge and a dull outboard edge, the rearward end of the front segment having a larger width than the frontward end with a gradually decreasing diameter therebetween, the furthest extent of the frontward end being formed into a point, the rearward end having a screw aperture extending therethrough a short distance from its furthest extent, the rearward end including a slanted projection extending therefrom, the angle between the projection and the remainder of the front segment measuring about one hundred and thirty five degrees, the rear segment being fabricated of plastic and formed in a generally planar circular configuration with a large circular aperture extending therethrough, the rear segment having a hole at its furthest frontward extent to permit coupling upon the projection of the front segment, the rear segment adapted to be held with the user's thumb extending therethrough in the operative orientation; a circular cutter formed in a thin planar generally circular configuration with a sharp outer edge, the center point of the cutter having a screw aperture extending therethrough, the cutter adapted to hold the topping of a pizza in place while being cut by the user; and a wing nut and bolt, the bolt formed in a generally cylindrical configuration with a planar head and a plurality of external screw threads around the outboard portion of its shaft, the wing nut having two planar semi circular components with a semi spherical shaped component positioned therebetween, the semi spherical component including a plurality of internal screw threads, the bolt adapted to be positioned through the aligned screw holes in the blades and cutter with the wing nut securely retaining the components therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved pizza cutting scissors which have all the advantages of the prior art pizza cutters and none of the disadvantages.

It is another object of the present invention to provide new and improved pizza cutting scissors which may be easily and efficiently manufactured and marketed.

It is further object of the present invention to provide new and improved pizza cutting scissors which are of durable and reliable constructions.

An even further object of the present invention is to provide new and improved pizza cutting scissors which are susceptible of a low cost of manufacture with regard to both materials and labor, and which accordingly are then susceptible of low prices of sale to the consuming public, thereby making such pizza cutting scissors economically available to the buying public.

Still yet another object of the present invention is to provide new and improved pizza cutting scissors which provide in the apparatuses and methods of the prior art some of the advantages thereof, while simultaneously overcoming some of the disadvantages normally associated therewith.

Currently available pizza cutters are unable to cut adjacent to a bailing pan edge due to the awkward orientation of a round cutter in a square corner. This requires setting aside the pizza cutter and getting a knife or other utensil to separate the pieces. Often the user resorts to tearing apart the pizza with his hands resulting in burns to his fingers. The pizza cutting scissors provides one utensil which can both roller cut and snip at the pan edge in one simple, safe and efficient operation.

Still another object of the present invention is to cut pizza in an efficient and precise manner with the specially angled blades and circular cutter of the apparatus.

Lastly, it is an object of the present invention to provide new and improved pizza cutting scissor comprising: a first scissor blade having a front segment and a rear segment, the front segment formed in a planar rectangular configuration with a sharp inboard edge and a dull outboard edge, the blade including a screw aperture, the rear segment being formed in a planar circular configuration with a large aperture extending therethrough, the rear segment being coupled upon the rearward extent of the front segment, a second scissor blade having a front segment and a rear segment, the front segment formed in a planar rectangular configuration with a sharp inboard edge and a dull outboard edge, the front segment being slanted forming an angle of between about one hundred and one hundred and fifty degrees, the blade having a screw aperture extending therethrough, the rear segment being formed in a planar circular configuration with a large aperture extending therethrough, the rear segment being coupled upon the rearward extent of the front segment, a planar circular cutter with a sharp outer edge being coupled between the blades with a nut and bolt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
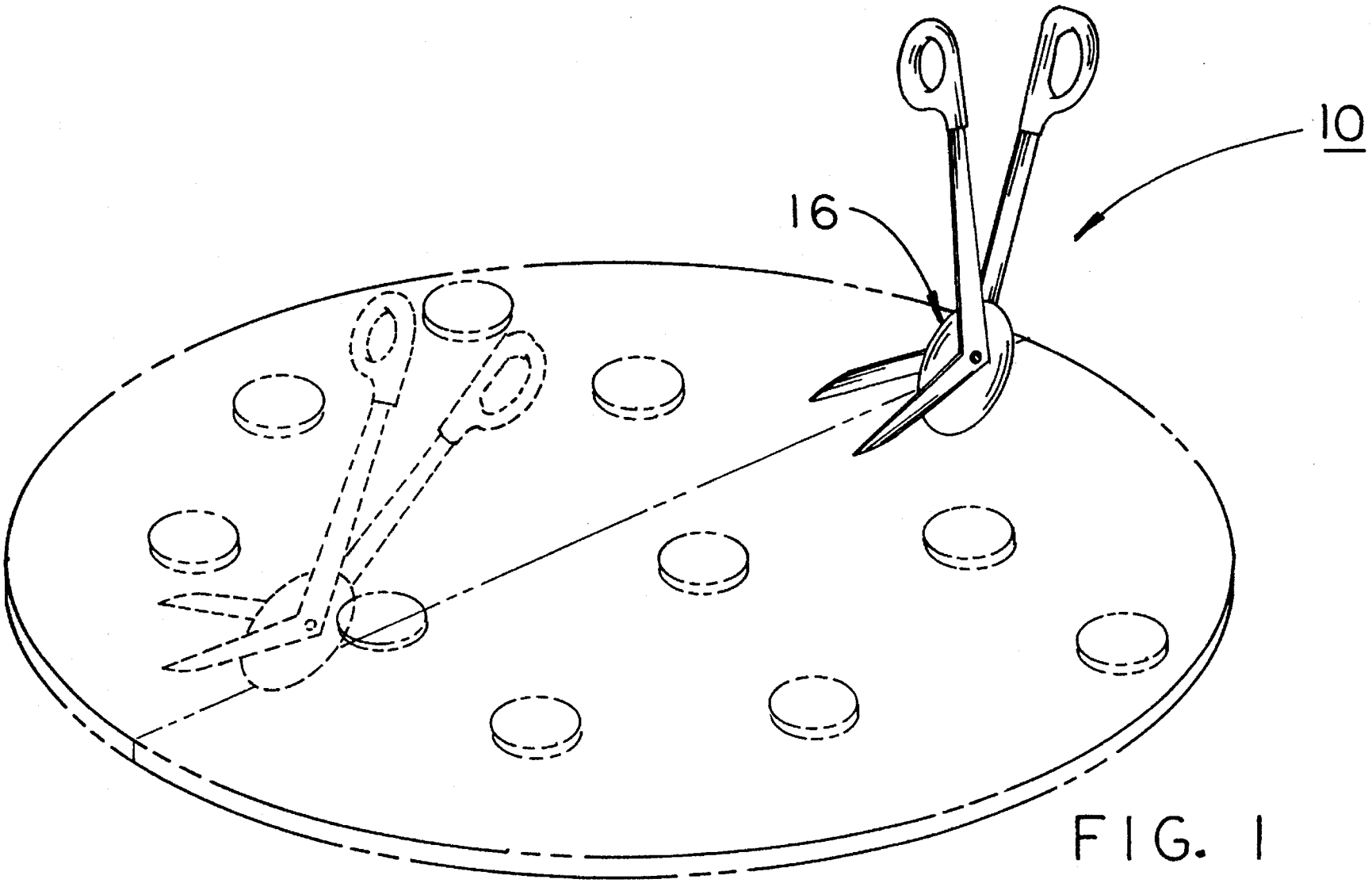
FIG. 1 is a perspective view of the preferred embodiment of the pizza cutting scissor constructed in accordance with the principles of the present invention.

With reference now to the drawings, and in particular to FIG. 1 thereof, the preferred embodiment of the new and improved pizza cutting scissor embodying the principles and concepts of the present invention and generally designated by the reference numeral 10 will be described.

The present invention, the pizza cutting scissor 10 is comprised of a plurality of components. Such components in their broadest context include a first scissor blade 12, a second scissor blade 14, a circular cutter 16, a nut 18 and bolt 20.

More specifically, the first scissor blade 12 has a front segment 22 and a rear segment 24. The front segment is fabricated of steel and formed in a long planar, generally rectangular configuration. The front segment has a sharp inboard edge 26 and a dull outboard edge 28. The rearward end of the front segment has a larger width than the frontward end with a gradually decreasing width therebetween. The furthest extent of the frontward end is formed into a point 30. The sharp blades enable the user to quickly and cleanly cut through a pizza. Note FIG. 1.

Figure 3:
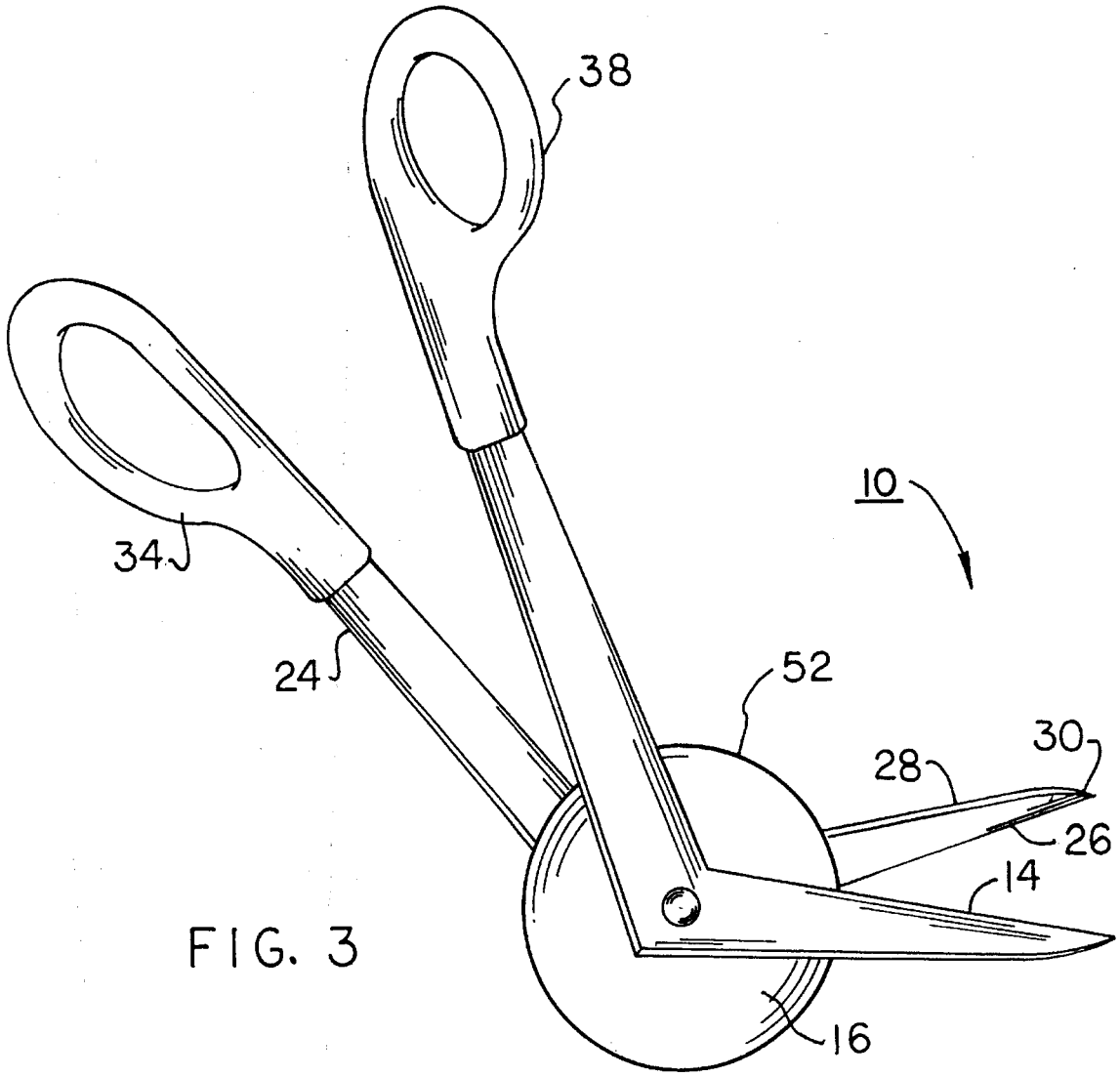
FIG. 3 is a side perspective view of the apparatus shown in the open orientation.

The segment has a screw aperture 32 extending therethrough. A handle 34 is affixed to the rear segment. The handle 34 is fabricated of plastic and formed in a generally planar oval configuration with a large oval aperture extending therethrough. The rear segment has a an aperture 32 at its furthest frontward extent to permit coupling upon the furthest rearward extent of the front segment. The handle is adapted to be held with the user's fingers extending therethrough in the operative orientation. The sturdy molded plastic is contoured to provide a comfortable gripping surface for the user. Note FIGS. 3 and 7.

A second scissor 14 blade has a front segment 36 and a rear segment 38. The front segment is fabricated of steel and formed in a long planar generally rectangular configuration.

The front segment has a sharp inboard edge 40 and a dull outboard edge 42. The rearward end of the front segment has a larger width than the frontward end with a gradually decreasing width therebetween. The furthest extent of the frontward end is formed into a point 44. The rearward end has a screw aperture extending through it a short distance from its furthest extent. The dull outboard edge of the blade helps prevent injury to the user. Note FIG. 3.

The rearward end includes a slanted projection 46 extending therefrom. The angle between the projection and the remainder of the front segment measures about one hundred and thirty five degrees. The rear segment is fabricated of plastic and formed in a generally planar circular configuration with a large circular aperture extending therethrough. The rear segment has a hole at its furthest frontward extent to permit coupling upon the projection of the front segment. The rear segment is adapted to be held with the user's thumb extending therethrough in the operative orientation. The angle of the projection enables the user to conveniently manipulate the pie without having to handle it with their fingers. Note FIGS. 1 and 3.

Figure 2:
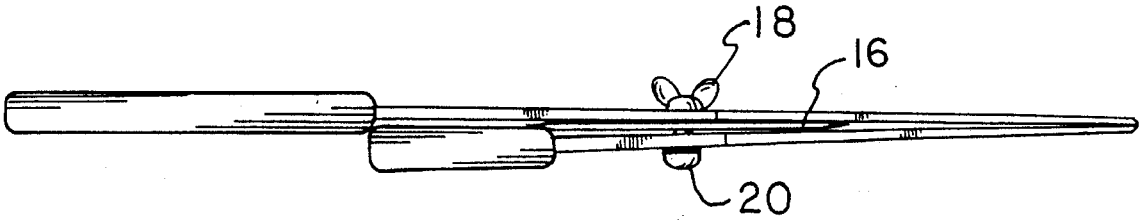
FIG. 2 is a bottom plan view of the apparatus shown in the closed orientation.
Figure 4:
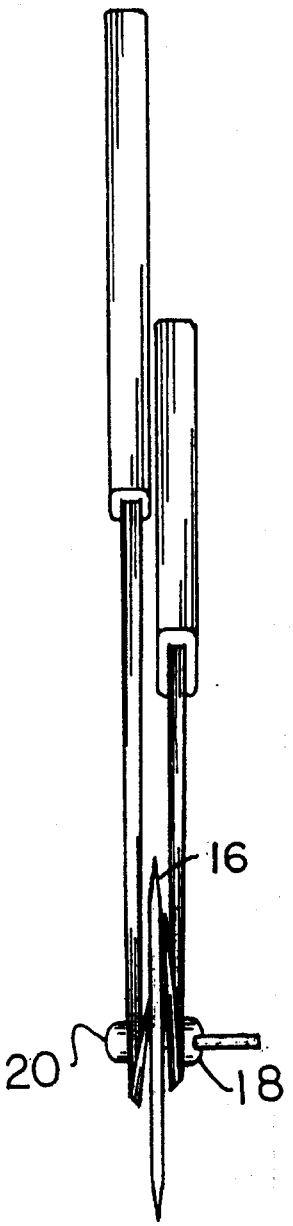
FIG. 4 is a bottom plan view of the apparatus shown in the open orientation.

A circular cutter 16 is formed in a thin planar, generally circular configuration with a sharp outer edge 52. The center point of the cutter has a screw aperture extending therethrough. The cutter is adapted to hold the topping of a pizza in place while being cut by the user. The cutter also insures that the dough as well as the topping are completely severed between slices. Note FIGS. 2 and 4.

Currently available pizza cutters are unable to cut adjacent to a bailing pan edge due to the awkward orientation of a round cutter in a square corner. This requires setting aside the pizza cutter and getting a knife or other utensil to separate the pieces. Often the user resorts to tearing apart the pizza with his hands resulting in burns to his fingers. The pizza cutting scissors provides one utensil which can both roller cut and snip at the pan edge in one simple, safe and efficient operation.

A wing nut 18 and bolt 20 are utilized in the apparatus. The bolt is formed in a generally cylindrical configuration with a planar head and a plurality of external screw threads around the outboard portion of its shaft. The wing nut is formed of two planar semi circular shaped components having and a semi spherical shaped component positioned therebetween. The semi spherical component includes a plurality of internal screw threads. The bolt is adapted to be positioned through the aligned screw holes in the blades and cutter with the wing nut securely retaining the components therebetween. The wing nut is easily uncoupled from the bolt when disassembly is required. Note FIGS. 2 and 7.

Figure 6:
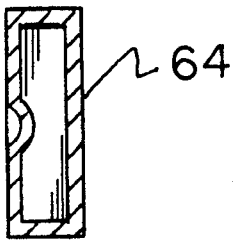
FIG. 6 is a cross sectional view of the extension tip component taken along line 6—6 of FIG. 5.
Figure 5:
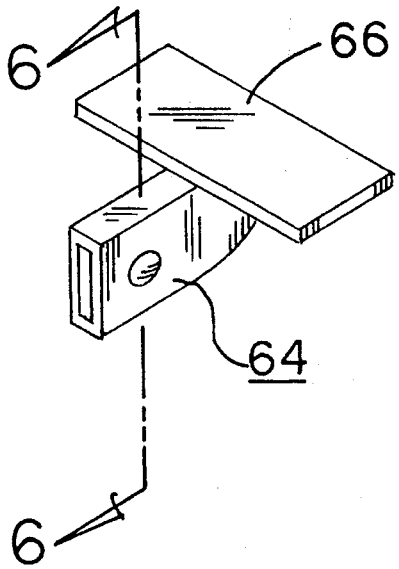
FIG. 5 is a perspective illustration of the extension tip component of an alternative embodiment of the apparatus.
Figure 7:
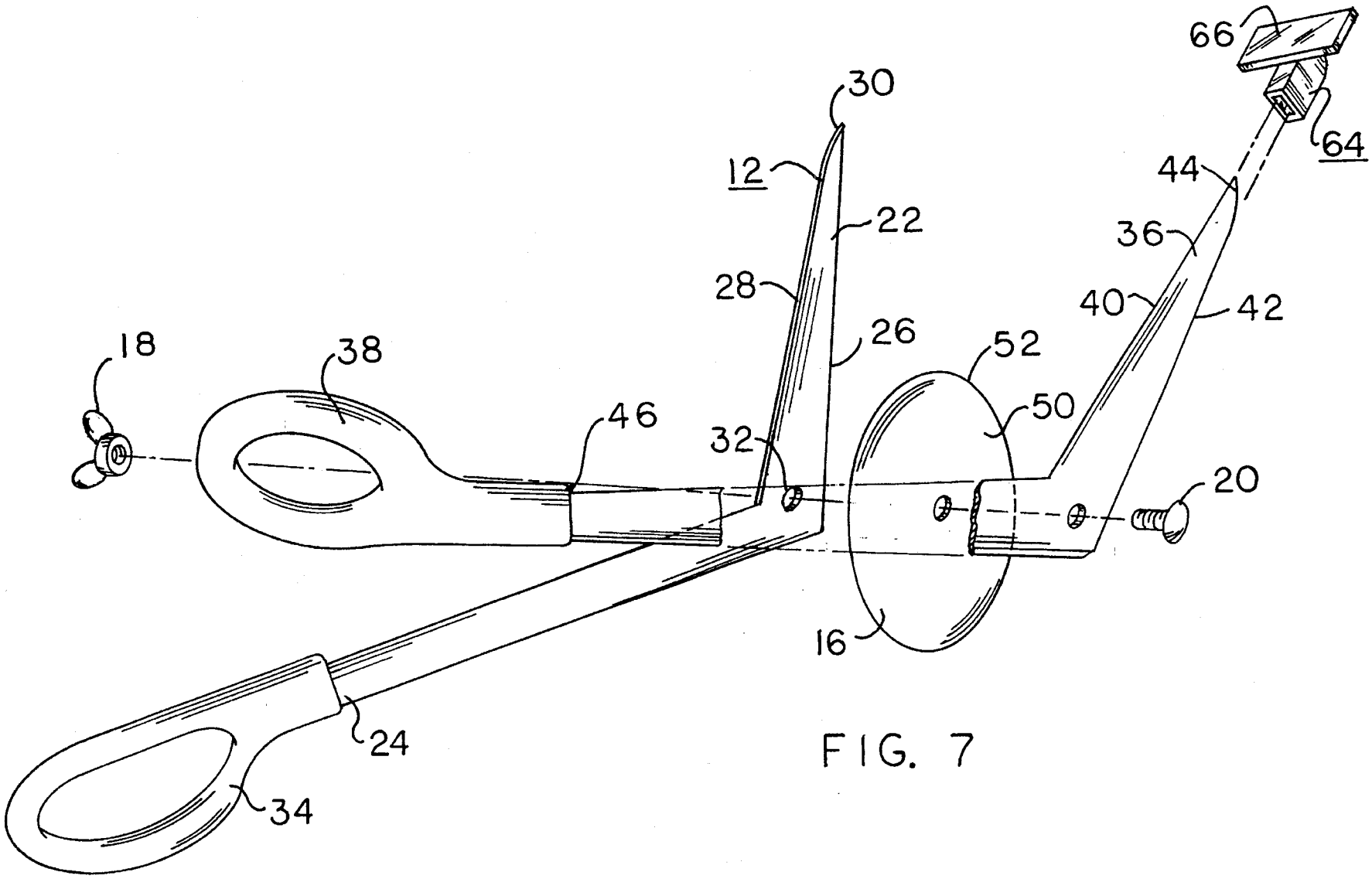
FIG. 7 is a separated perspective view of the pizza cutting scissor illustrating the positioning of the extension tip in the alternative embodiment of the apparatus, The same reference numerals refer to the same parts through the various Figures.

An alternative embodiment of the apparatus is shown in FIG. 7. In such embodiment at least one extension tip 64 is positioned on the front tips of the blades of the scissor. The tips are formed in a generally hollow rectangular configuration with a rectangular plate 66 affixed thereto. Note FIGS. 5 and 6. The plate includes a raised dimple. The tip is adapted to be securely positioned on the front points of the blades. The tips enhance the ability of the user to lift and grasp a pizza to be cut. The tips also permit the user to utilize the apparatus like a set of tongs for lifting hot objects. Note FIG. 7.

The pizza cutting scissor, as the name suggests, is designed to cut any pizza neatly and cleanly while the topping of the pie stays in place. The two scissor blades are joined in the conventional fashion and pivot on a centrally located bolt. In addition, a rotating cutter is also mounted on the bolt. This cutter is two and one quarter inches in diameter and straddled by the two cutting blades.

The scissor blades are four inches long, and the handle segment of one blade extends in a straight line as it does on its conventional counterpart. The additional feature is however, that the handle segment of the second scissor blade is appropriately angled to complement its function. This handle forms an inclusive angle of about one hundred and thirty five degrees with the blade. In this fashion, as the blade is laid flat against the pan or box containing the pizza, the handle will be elevated to forty five degrees from the pie so that it can be conveniently gripped and manipulated without the user's fingers contacting the pizza.

From the foregoing description, the use of the pizza cutting scissor becomes fairly obvious. One can quickly snip along the desired cutting line while the cutter follows closely behind to cleanly cut both the dough and the topping in one pass. Everyone has experienced the alternative method, trying to remove a slice which is not cleanly severed from an adjacent section. This typically results in much of the topping falling on to the neighboring piece resulting in an unsightly mess. The unique and novel pizza cutting scissor addresses and eliminates these problems.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pair of new and improved pizza cutting scissors comprising, in combination:

a first scissor blade having a front segment and a rear segment, the front segment being fabricated of steel and formed in a long planar generally rectangular configuration, the front segment having a sharp inboard edge and a dull outboard edge, the rearward end of the front segment having a larger width than the frontward end thereof with a gradually decreasing width therebetween, the furthest extent of the frontward end being formed into a point, a handle fabricated of plastic being affixed to the rear segment and formed in a generally planar oval configuration with a large oval aperture extending therethrough, the rear segment having a screw aperture at its furthest frontward extent to permit coupling upon the furthest rearward extent of the front segment, the handle adapted to be held with user's fingers extending therethrough in an operative orientation;

a second scissor blade having a front segment and a rear segment, the front segment being fabricated of steel and formed in a long planar generally rectangular configuration, the front segment having a sharp inboard edge and a dull outboard edge, the rearward end of the front segment having a larger width than the frontward end thereof with a gradually decreasing width therebetween, the furthest extent of the frontward end being formed into a point, the rearward end including a slanted projection extending therefrom, the angle between the projection and the remainder of the front segment measuring about one hundred and thirty five degrees, the rear segment being fabricated of plastic and formed in a generally planar circular configuration with a large circular aperture extending therethrough, the rear segment having a screw aperture at its furthest frontward extent to permit coupling upon the projection of the front segment, the rear segment adapted to be held with the user's thumb extending therethrough in the operative orientation;

a circular cutter formed in a thin planar generally circular configuration with a sharp outer edge, the center point of the cutter having a screw aperture extending therethrough, the cutter adapted to hold the topping of a pizza in place while being cut by the user; and a wing nut and bolt, the bolt formed in a generally cylindrical configuration with a planar head and a plurality of external screw threads around the outboard portion of its shaft, the wing nut having two planar semi circular components with a semi spherical shaped component positioned therebetween, the semi spherical component including a plurality of internal screw threads, the bolt adapted to be positioned through the the screw apertures in the blades and cutter with the wing nut securely retaining the blades and cutter therebetween.

2. A pair of new and improved pizza cutting scissors, comprising:

a first scissor blade having a front segment and a rear segment, the front segment formed in a planar rectangular configuration with a sharp inboard edge and a dull outboard edge, the blade including a screw aperture, the rear segment being formed in a planar circular configuration with a large aperture extending therethrough, the rear segment being coupled upon the rearward extent of the front segment, a second scissor blade having a front segment and a rear segment, the front segment formed in a planar rectangular configuration with a sharp inboard edge and a dull outboard edge, the front segment being slanted forming an angle of between about one hundred and one hundred and fifty degrees, the second scissor blade having a screw aperture extending therethrough, the rear segment being formed in a planar circular configuration with a large aperture extending therethrough, the rear segment being coupled upon the rearward extent of the front segment, a planar circular cutter with a sharp outer edge being coupled between the blades with a nut and bolt, the cutter being removable so that the scissor can be used to cut meat or other food stuffs.

3. The scissors as set forth in claim 2 wherein the scissors can be fabricated in a plurality of sizes to accommodate a wide range of pizza cutting requirements.

4. The scissors as set forth in claim 2 and further including:

at least one extension tip formed in a generally hollow rectangular configuration with a rectangular plate affixed thereto, the tip adapted to be securely positioned on the front points of the blades, the tip enhancing the ability of a user to lift and grasp a pizza to be cut, the tip also permitting a user to utilize the scissors as a set of tongs for lifting hot objects.

* * * * *